United States Patent [19]

Fricke et al.

[11] 4,265,157

[45] May 5, 1981

[54] SYNTHETIC PRODUCTION OF SOUNDS

[75] Inventors: Jobst Fricke; Wolfgang Voigt; Jürgen Schmitz, all of Cologne, Fed. Rep. of Germany

[73] Assignee: Colonia Management-und Beratungsgesellschaft mbH & Co., K.G., Fed. Rep. of Germany

[21] Appl. No.: 924,726

[22] Filed: Jul. 14, 1978

Related U.S. Application Data

[63] Continuation of Ser. No. 674,830, Apr. 7, 1976, abandoned.

[30] Foreign Application Priority Data

Apr. 8, 1975 [CH] Switzerland ..... 4411/75

[51] Int. Cl.[3] ..... G10H 1/02

[52] U.S. Cl. ..... 84/1.19; 84/1.01

[58] Field of Search ..... 84/1.01, 1.03, 1.11, 84/1.12, 1.19, 1.24, 1.25, 1.26, DIG. 9, DIG. 11

[56] References Cited

U.S. PATENT DOCUMENTS

| | | | |
|---|---|---|---|
| 3,166,622 | 1/1965 | Neustadt | 84/1.01 |
| 3,213,180 | 10/1965 | Cookerly et al. | 84/1.11 |
| 3,247,309 | 4/1966 | Campbell | 84/1.03 |
| 3,429,976 | 2/1969 | Tomcik | 84/1.12 |
| 3,439,106 | 4/1969 | Goodale | 84/1.27 |
| 3,535,969 | 10/1970 | Bunger | 84/1.11 |
| 3,538,806 | 11/1970 | Bunger | 84/1.12 |
| 3,663,735 | 5/1972 | Evans | 84/1.11 |
| 3,688,010 | 8/1972 | Freeman | 84/1.11 |
| 3,716,647 | 2/1973 | Kamedka et al. | 84/1.11 |
| 3,767,833 | 10/1973 | Noble et al. | 84/1.01 |
| 3,809,786 | 5/1974 | Deutsch | 84/1.01 |
| 3,919,648 | 11/1975 | Uetrecht | 84/1.19 X |
| 3,956,960 | 5/1976 | Deutsch | 84/1.19 |
| 3,972,259 | 8/1976 | Deutsch | 84/1.24 |
| 3,977,290 | 8/1976 | Sakashita | 84/1.01 |
| 3,992,973 | 11/1976 | Howell | 84/1.23 |
| 4,002,095 | 1/1977 | Mantani | 84/1.22 |

FOREIGN PATENT DOCUMENTS

| | | | |
|---|---|---|---|
| 1902376 | 9/1969 | Fed. Rep. of Germany | 84/1.01 |
| 1622161 | 10/1970 | Fed. Rep. of Germany | 84/1.01 |
| 2029582 | 12/1971 | Fed. Rep. of Germany | 84/1.01 |
| 2221336 | 11/1973 | Fed. Rep. of Germany | 84/1.01 |

*Primary Examiner*—J. V. Truhe
*Assistant Examiner*—Forester W. Isen
*Attorney, Agent, or Firm*—Brumbaugh, Graves, Donohue & Raymond

[57] ABSTRACT

A method and apparatus for producing sounds from one or more-time overlapping sequences of one or more electrical pulse signals having a frequency corresponding to the pitch of the sound to be produced from the signals holding the pulse width or pulse pause width in each sequence substantially constant for signals corresponding to a range of pitches of the sound to be produced. The pulse widths or pulse pause widths are then relatively abruptly changed over a short interval in pitch at the upper limit of the range. In this way, the shape of each pulse in a sequence and the phase between pulses in concurrent sequences which determine the timbre of the sound remains the same over the range of sounds to permit the method and apparatus to accurately duplicate the sounds of traditional musical instruments.

28 Claims, 7 Drawing Figures

FIG. 1A
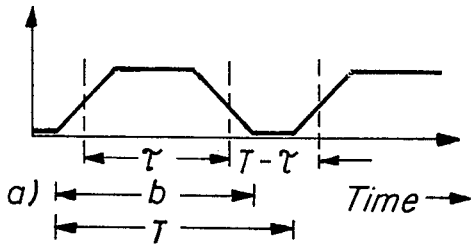
FIG. 1B
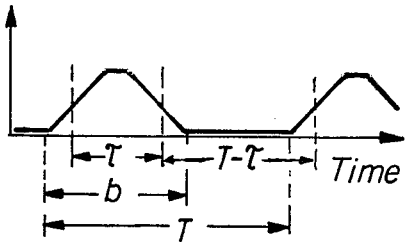
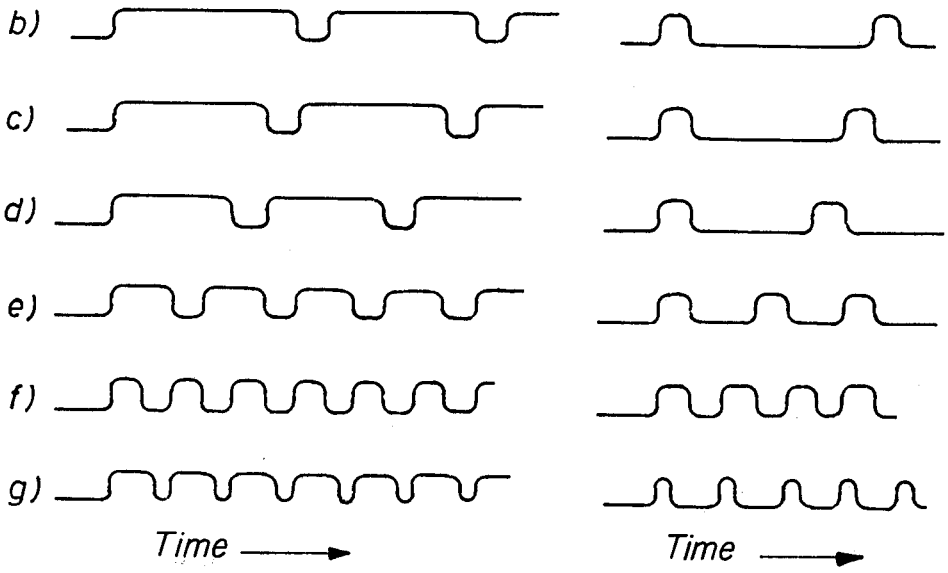
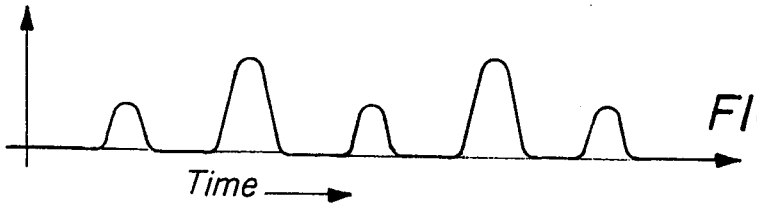
FIG. 2
FIG. 3
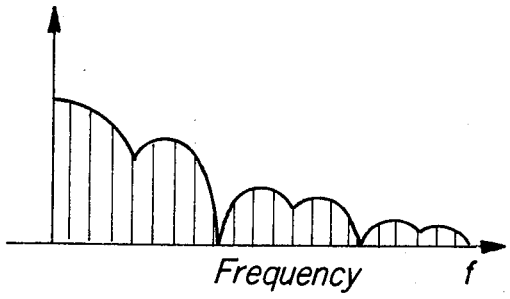

SYNTHETIC PRODUCTION OF SOUNDS

This is a continuation, of application Ser. No. 674,830, filed Apr. 7, 1976, now abandoned.

BACKGROUND OF THE INVENTION

For the synthetic production of sounds of a predetermined timbre two methods are chiefly or significance, which are based on different initial assumptions:

(a) The part tone structure of the desired sound is composed from individual sinusoidal part components; or (b) the part tones of the desired sound are taken from sounds or noises by filtration, which comprise the required part tones in a sufficient number and with a sufficient volume.

Sounds as can be produced for example with musical instruments, have in the stationary case spectra of purely harmonic spectral components. Such sounds can therefore only be produced by the above mentioned methods and cannot be produced by modulating methods for sound synthesis, which lead to non-harmonic spectra but these spectra however are of significance for choral effects, finely modulated events and attack and decay events. The natural character of the sounds of musical instruments and the like is therefore determined by a quasi-stationary sound development (harmonic spectrum) with "timbre modulation" (Meyer-Eppler 1949) and noise fractions.

The phase position of the part tones is generally not taken into account in synthetic sound production. In the case (a) it is difficult to monitor and in case (b) it represents a secondary accompanying phenomena of sound or noise productions, which is taken as a basis (for example delta pulse, saw-tooth) and of the following filter networks.

If in sound synthesis SCHUMANN'S Timbres Laws are to be taken into account, something which is necessary in order to obtain the best possible representation of natural sounds, the spectral enveloping curve must be precisely controlled for part tone synthesis or filtering, something which involves substantial problems.

Accordingly one aim of the present invention is that of providing a new method and new devices for synthetic electronic sound production, in the case of which formant formation, SCHUMANN'S Timbres Laws and also the quasi-stationary sound development can be easily controlled and at the same time the correct phase relationships can be maintained between the part tones.

These and further aims are to be attained by the invention.

While a German Patent Specification (Patentschrift No. 1,902,376) refers to a generator for the simultaneous production of tones of a musical scale which is preferably completely tempered, in the case of which the signals for the different tones consist respectively of pulse sequences, which comprise all pulses of one duration, the pulses of the pulse sequences for two different tones however form different pulse patterns, and since the pulses are not regularly distributed in the pulse series, it is not possible to use the pulse series directly as tone signals, since a tone produced from such a pulse series makes a very unpleasant impression on the ear.

SUMMARY OF THE INVENTION

The method in accordance with the invention is based on the following knowledge: As is known all time functions can be converted with the help of Fourier's Theorem into spectral functions (which represent the dependency of the amplitude on frequency). For certain periodic time functions with a pulse-like character, as are typical for example for many conventional musical instruments, there are zero positions or minima in the (harmonic) spectrum. Between such minima there are zones of an increased spectral energy with a formant character. The position of the minima in the spectrum and therefore at the same time that of the maxima (formants) is determined by the ratio of effective pulse duration tau to the duration T of the overall cycle of the oscillation.

The FOURIER development of a pulse sequence consisting of rectangular, triangular or cosinusoidal pulses comprises as is known the expression $(\sin x)/x$, in which $x=(pi \cdot k \cdot tau)/T$ and $k=1, 2, 3, \ldots$ denote the serial number of the spectral lines.

One feature of the sounds of many musical instruments is the presence of fixed formants, that is to say formants substantially independent of the fundamental pitch of the sounds. The formation of formants, whose frequency is independent from the pitch, that is to say the cycle duration T, clearly means that tau must be independent of the cycle duration T.

Zero positions in the spectrum arise for $x=n \cdot pi=pi \cdot k \cdot f_1 \cdot tau$ and in this respect $n=1, 2, 3, \ldots$ and $f_1=1/T$. Zero positions thus occur at the frequencies $k \cdot f_1=n/tau$.

In order to produce a sound with pre-established formants independent of the fundamental pitch in accordance with a desired timbre, in the case of the method in accordance with the invention therefore pulses are produced, whose repetition frequency determines the pitch of the desired sound and whose duration tau is selected in accordance with the formant distribution and at least in certain extended ranges is independent of the pitch.

Since in acoustics positive and negative pulse phases are equivalent the condition tau=const. can also be replaced by $\text{const.}=T\text{-}tau \leqq tau$.

The effective pulse duration tau is in the case of a rectangular pulse equal to the breadth b of the pulse and in the case of triangular and cosinusoidal pulses is equal to b/2.

The position and the height of the maxima (formants) of the spectral distribution (in the case of a fixed tau) are furthermore determined by the shape of the pulses. Special shapes of the spectral envelop curves with fixed formants can be realized by the combination of several pulse sequences, as will be explained in what follows.

DESCRIPTION OF THE DRAWINGS

In the following description examples of the method in accordance with the invention and preferred means, which operate in accordance with the present invention will be explained in detail with reference to the accompanying drawings in which:

FIGS. 1A and 1B show complementary pulse sequences as they can be used in the case of the present method for the production of sounds with a predetermined timbre and different pitches, the vertical graph axis denoting amplitude;

FIG. 2 shows a graph of double pulse sequence, the horizontal axis representing time;

FIG. 3 shows a graph of an enveloped curve of a spectral distribution, which can be produced by a so-called "double pulse sequence", the vertical axis denoting the amplitude and the horizontal axis denoting frequency;

DESCRIPTION OF THE PREFERRED EMBODIMENTS

Figure 4:
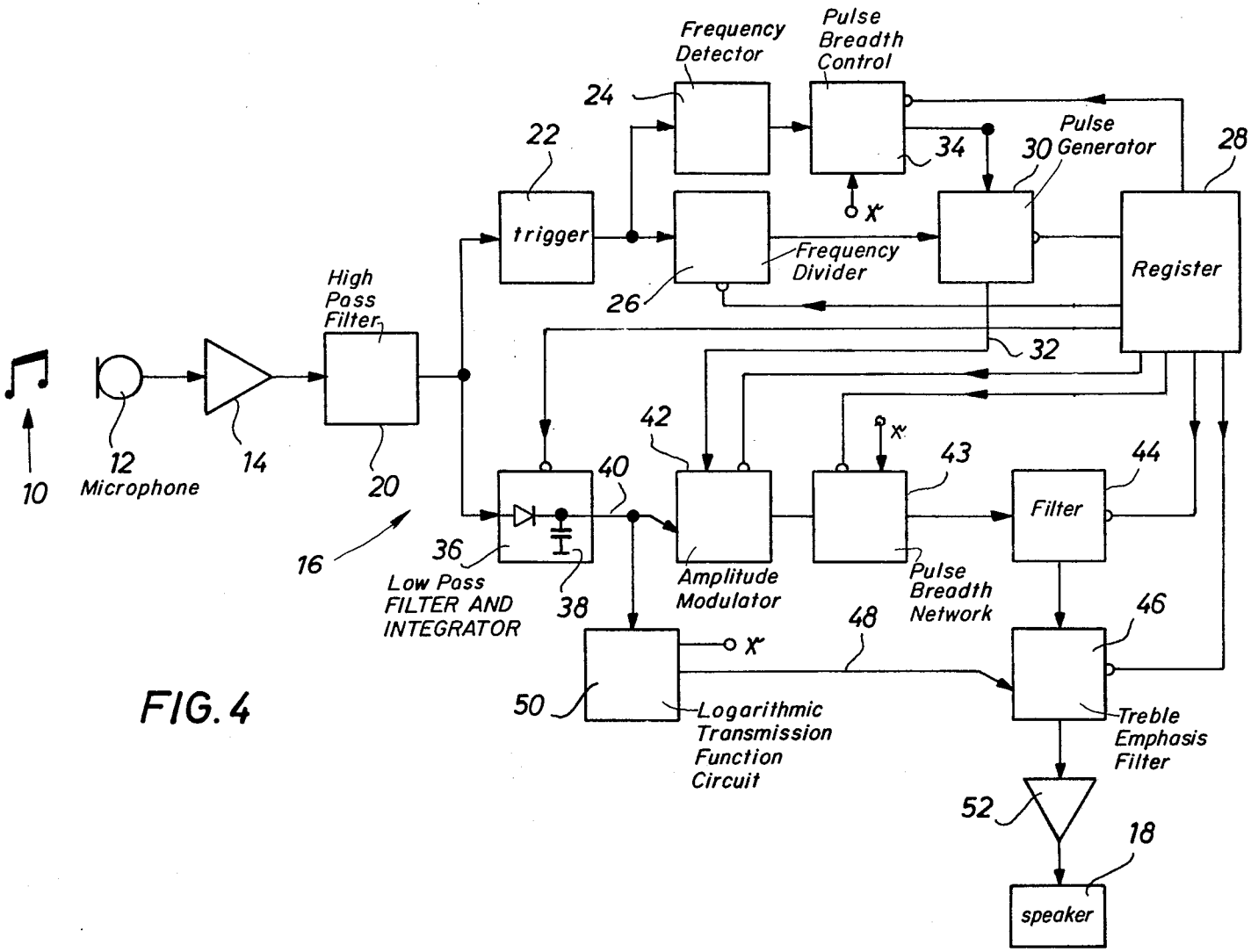
FIG. 4 shows a block circuit diagram of an electronic device in the case of which sound production can be carried out using the method in accordance with the invention or by means of another (known) method.

In FIGS. 1A and 1B the curves in line (a) represent two complementary pulse sequences which, assuming the same pulse shape, correspond to sounds with the same pitch and timbre, since the cycle T of the two pulse sequences is the same and the effective pulse duration tau of the pulse sequence in line (a) in FIG. 1A is equal to the pulse pause duration T-tau of the pulse sequence in line (a) of FIG. 1B.

In accordance with the invention both in the case of the pulse sequences of the type represented in FIG. 1A*a* and also with those of the type represented in FIG. 1B*a* with an increase in pitch the shape and duration of the parts, determining the timbre, remain constant over a pre-established pitch range as will be seen for example from curves (b) to (f) in FIGS. 1A and 1B. In the case of the curves (b) to (f) of FIG. 1A the pulse purse duration T-tau remains constant and in the case of the curves (b) to (f) in FIG. 1B the pulse duration tau remains constant, while the cycle duration T decreases proportionally with an increase in pitch. This rule applies generally for at least one or two octaves. In the case of a greater tonal scope, however, on exceeding a predetermined pitch, the pulse duration (or the pulse pause duration), which was previously constant, is either reduced suddenly between two tones or (preferably in the case of instruments with a continuous tonal value range) within a relatively small tone interval (for example of a diminished semi-tone to a diminished third) down to a fraction as for example half, of the preceding value and then remains constant for a fairly large tonal value interval. In this manner it is possible in a simple fashion to imitate the shifts, occurring in the case of the sounds of musical instruments, with respect to the minima of the frequency-amplitude function. It is thus possible for example to pass from the curve (f) or possibly even from the curve (e) to the curve (g), in which the characteristic time interval is half as large as previously.

The reduction in the pulse duration is preferably undertaken in the case of the imitation of musical instrument sounds at a position in the musical scale where, in the case of the musical instrument to be imitated, a change in the sound producing event is undertaken, for example in the case of a stringed instrument on a step in a note at which there is normally a change in string and in the case of a wind instrument on overblowing. It can be advantageous to shorten the pulse duration (pause duration) when the pitch (cycle duration) comes close to the above mentioned limit within a certain pitch range and then, on reaching the limit to reduce it to the new value (for example one half). Therefore, for example for imitating trumpet sounds with an increase in pitch, firstly the pulse duration (or the pulse pause duration) is held constant for approximately 1.5 octaves and then during about half an octave it is shortened proportionally to $T^m$, in the case of which m lies between 0 and 1 and is then reduced within a whole or half a tone or note interval to half the original constant value.

It can also be advantageous to shorten the pulse duration or the pulse pause duration in a manner analogous to the cycle duration following the pitch range in which the pulse or pause duration is constant or following the pitch range in which the duration is shortened proportionally to $T^m$. In the case of the production of wood wind sounds it has been found convenient to keep the pulse or pause duration constant for approximately two octaves and then to carry out shortening either proportonally to $T^m$ over the range of a quint and then to carry out sudden, further shortening to half the original pulse duration or to shorten from the "constant" range immediately to the half-value and then to keep the pulse or pause duration respectively constant again. For the imitation of the sounds of stringed instruments it has been found acceptable to keep constant the pulse or pause breadth over ranges of respectively one quint and in between to reduce the pulse or pause duration substantially suddenly to $\frac{2}{3}$.

Simple pulse sequences of the type represented in FIG. 1 provide sounds, whose over-wave or envelope spectra provide minima or zero positions with a simple cycle and intermediate formant ranges. The position and height of the maxima (formants) in the case of a fixed pulse duration (the same applies here and in what follows as a matter of course also for fixed pulse pause durations) are additionally determined by the shape of the pulses. In the curves (b) to (g) for example rectangular pulses are represented with rounded corners. Rectangular pulses with sharp corners will only be acceptable in exceptional cases, since they provide very rough and artifical sounding sounds. It is preferred to use polished rectangular pulses of the type represented, triangular pulses, and pulses in the form of half a cosine oscillation, which can be easily produced and if necessary can be shaped by further following filters.

Special shapes of the enveloped curves of the overwave distribution with fixed formants can be realized by double and multiple pulse sequences.

One example of a double pulse sequence is represented in FIG. 2. It comprises two pulse sequences, shifted respectively by half a cycle, with the same cycle and pulse duration and pulse shape though with a different pulse amplitude. The two pulse sequences can however also differ in addition to the amplitude or instead of it in respect of other parameters as well. FIG. 3 shows the spectral distribution (frequency-amplitude function) of a sound, which was produced by another double pulse sequence.

Multiple pulse sequences or pulse rhythms can consist of several telescoped pulse sequences, which have different cycles and possibly pulses with different breadths and/or amplitudes changing from pulse sequence to pulse sequence and which together make up an overall sequence, whose cycle $T_g$ is represented by the minimum common multiple of the individual cycles $t_p$. A pulse rhythm thus consists for example of a periodically repeated group of two, three or more pulses, which can have a different shape and/or breadth and/or amplitude. If the human ear is acted upon by several oscillaton trains with oscillaton cycles having a rational relation to each other, as is known the pitch impression is determined by the minimum common multiple of the invidividual cycles.

Whether the pulse sequences consist of individual pulses or pulse groups (pulse rhythms) and what shape and duration the respective pulses have depends, as stated, on the spectrum of the sounds to be produced. It is however to be expressly pointed out that within the pitch range, in which the pulse duration is to be absolutely constant and independent from pitch (frequency) the shape and duration of the pulses or, respectively, in the case of pulse rhythms of the "pulse pattern" are identical from tone to tone or note to note. (In this range the duty cycle therefore changes).

The spectrum of the sounds which are represented by the pulse sequences described can if desired be further shaped by a filter, which in particular cases can be constructed as a formant filter, which serves for imitation of the sounds of a musical instrument though generally it serves for imitation of the transmission and radiating function of the respective musical instrument. In imitating the sounds of a musical instrument this filter is preferably also used for adding the attacks. In accordance with the general course of the radiation function it will inter alia bring about a reduction in the base and an emphasis of trebles and is preferably so designed as regards the attack constant that the output signal of the filter has an attack behavior which is as similar as possible to the natural sounds of the respective musical instrument. In this respect further details will be provided on describing the means for carrying out the method of the present invention.

The change in volume is preferably not carried out by simple linear change in amplitude but taking into account SCHUMANN'S Shift Law, as is represented in the German patent specification No. 2,041,426. In the case of the present method therefore preferably with an increase in volume the pulse flanks are made steeper and/or there is a slight shortening of the effective pulse duration (or pause duration) while the cycle duration remains unchanged. Instead of these measures or in addition to them it can be advantageous to provide a broad band treble emphasis with an increase in volume, for example for approximately 1 to 6 kHz with a maximum at about 3 kHz.

A timbre modulaton and a quasi-stationary sound development can be brought about using static variations of the pulse breadth, cycles and forms without discontinuous phase movements of the part tones or notes. The statistical variations can be brought about by signals, which are filtered out from a statistical noise voltage.

In the case of the present method for timbre synthesis, more particularly for the imitation of the sounds of musical instruments, use is therefore made of pulse sequences with the effective pulse duration tau whose tau value is substantially independent from the fundamental frequency $F_1=1/T$. The position of the formants between the zero positions or minima of the over-wave spectrum is additionally precisely defined by the pulse shape. Special shapes of the spectral envelope curve with fixed formants are realized by double or multiple pulse sequences or "pulse rhythms". The spectra of the sounds so produced can be modified by a following filter with the properties of the transmission and radiation function of the musical instrument which is imitated.

On passing over to sounds with a higher pitch and with the maximum pitch of the respective instrument imitated, modifying the principle tau=const., there occurs firstly a gradual and then a sudden shortening of the effective pulse duration (or pulse pause) down to half the breadth, that is to say the frequency gaps of the minima in the spectrum are enlarged. In the case of the imitation of special instrument sounds, a reduction in the pulse duration by factors other than 2 may be appropriate.

The different volume impressions or dynamic degrees are brought about more particularly by a continuous pulse deformation with transitions with differing slopes, possibly in conjunction with a change in the duty cycle tau/T with a fixed value for T and/or a broad band treble emphasis between 1 and 6 kHz. The natural sound character is further imitated by a statistical change in the pulse breadths, pauses and shapes.

The method described above can be used in the most various different manners in practice, for example by realizing the above described functions with the use of suitable electronic units. It is for example possible to construct a key-instrument like an organ, which has corresponding registers.

Figure 5:
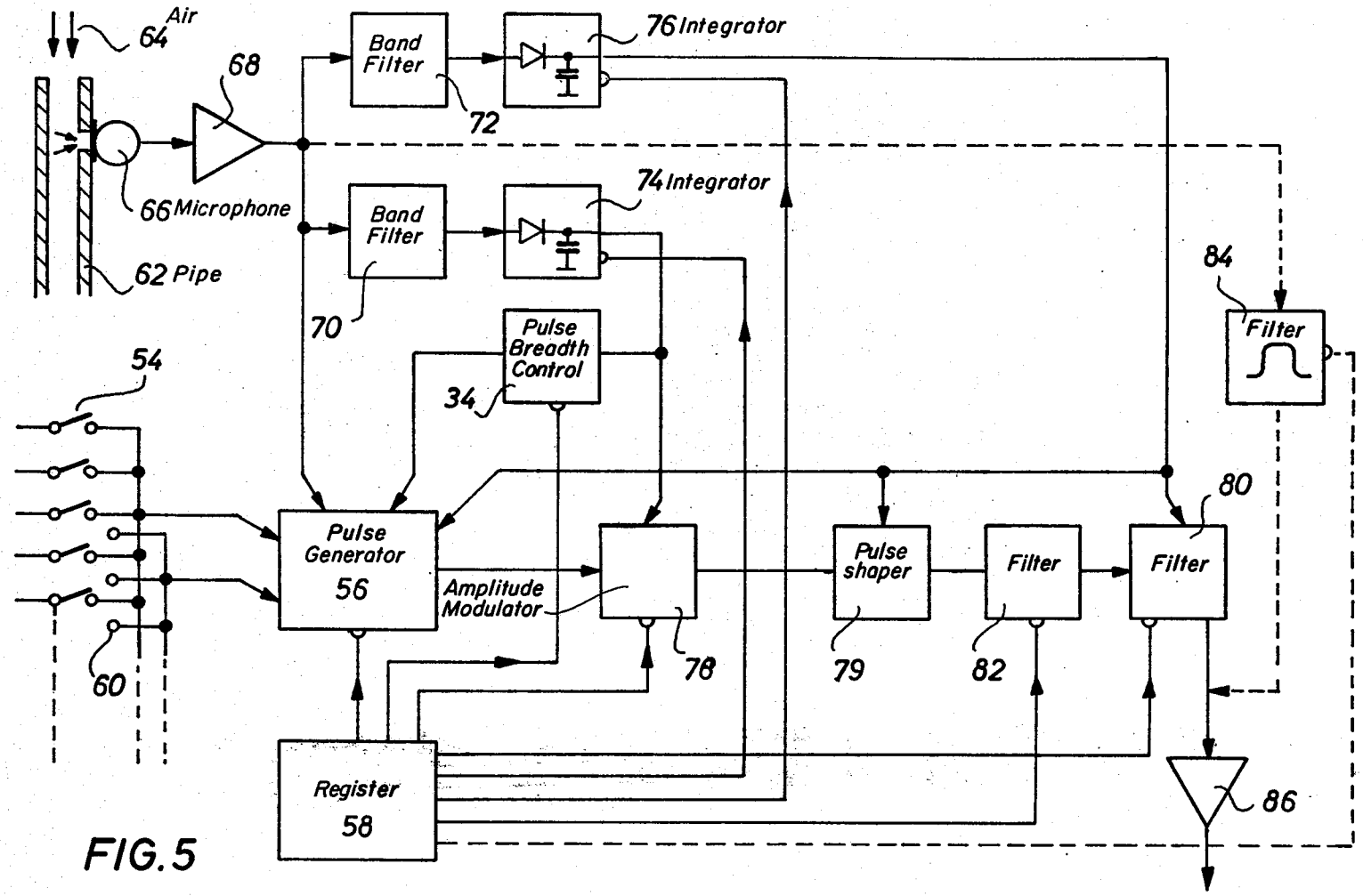
FIG. 5 is a block circuit diagram of an electronic wind instrument in the case of which sound production can be carried out using the method in accordance with the invention or by means of another sound producing method.

In what follows with reference to FIGS. 4 and 5, two novel devices are described, which can be realized especially advantageous using the method in accordance with the invention, but however in principle can also be realized with conventional arrangements for sound synthesis.

In the case of the device as shown diagrammatically in FIG. 4, it is a question of an electronic adapter, which can be driven by a conventional musical instrument or also by the human voice and makes it possible to produce other sounds, more particularly the sounds of other musical instruments or also sounds of quite different timbres. The fine modulating events produced by the player on the instrument operated or by the use of his voice (attacks, vibrato, tremolo and the like) are transferred to the electronically produced sounds. It is possible with the electronic adapter in accordance with FIG. 4 for example to produce an instrumental sound with any desired timbre by the use of a conventional monophonic instrument. It can be used for example, on being driven by any desired instrument, to imitate other instruments of the same general class and also to produce artificial sounds, for example it is possible to imitate with a wind instrument any other desired wind instrument as for example, more specifically, it is possible to imitate an oboe or a bassoon by means of a recorder.

The primarily produced sounds 10 made by the performer using an instrument or by means of his own voice are received by a microphone 12, amplified in an amplifier 14 and after processing by a circuit arrangement 16, to be described below, they are reproduced by means of a loudspeaker 18 or they can be recorded.

The driving instrument or the voice supply the frequency and amplitude to the circuit arrangement 16 while the timbre of the primarily produced sounds remains out of consideration. The two parameters frequency and amplitude comprise all significant information, including the type of fine modulation, with the exception of the timbre and accordingly they can be impressed on the newly produced timbre in a manner corresponding to the natural sound.

The signal amplified in the amplifier 14 passes through a high pass filter 20 for suppressing low frequency interfering noise such as contact noise and the like and further preferably passes through a threshold stage (not shown) which ensures that the tone production only starts at a certain blowing power or energy and it is then processed in two separate channels as regards the frequency and amplitude information. As regards the frequency, the signal is converted by a trigger circuit 22 into a rectangular oscillation of the same fundamental frequency. The rectangulr oscillation from the output of the trigger circuit 22 is passed to a frequency detector 24 and to a divider circuit 26. The divider circuit 26 can be adjusted by means of a register 28 to different dividing factors n (including 1) and makes possible, more especially, the octave-wise reduction of the fundamental frequency for imitating a "bass" instrument by a "treble" one. Instead of the divider circuit 26 (or in addition to it is possible to use, if desired, a frequency multiplying circuit which can be driven by the register 28. The output frequency of the divider circuit 26 (or of the corresponding multiplier circuit) drives a pulse generator 30, which produces at its output 32 pulses, whose breadth depends on the frequency and can be controlled by the output signal of a pulse breadth control circuit 34, which for its part is so driven by the output signal of the frequency detector 24 that for imitating an analogous event in the case of the natural instrument the breadth of the pulses changes over as from a certain pitch, possibly differing from instrument to instrument, of the basic or fundamental frequency to a narrower value (for example half the breadth) preferably in a continuous manner. While controlling the frequency detector 24 responsing to the frequency of the pulses supplied to its input, the pulse breadth control circuit 34 supplies for this purpose as from a certain threshold frequency a control voltage to the pulse generator 30 which reduces the breadth of the pulses within a pre-established pitch interval. The pulse sequence obtained in this manner at the output 32 takes into account all information comprised in the controlling frequency and the pulse behaviour necessary for obtaining the respective sound to be produced.

In order to obtain the amplitude information the preamplified and filtered signal from the output of the high pass filter 20 is rectified in a rectifier and low pass filter circuit and it is integrated. The integration constant can be adjusted by the register 28, for example by switching over a parallel connected capacitance 38. By dint of the direct voltage at the output line 40 of the rectifying and low pass filter circuit 36 the amplitude of the pulse sequence, produced by the pulse generator 30 is amplitude modulated in an amplitude modulator 42. In this respect preferably the dynamic behavior of the instrument to be imitated is adapted to suit that of the one driving instrument. This is carried out by compressing and, respectively, expanding the modulation degree of the amplitude modulator 42, which by means of the register 28 can be set, and by matching the integration time constant of the rectifying and low pass filter circuit 36. The circuit arrangement 42 can comprise a threshold member so that the amplitude modulation only becomes effective as from a certain amplitude threshold and the tone production only starts when the sound 10 reaches a predetermined volume. The output signal of the amplitude modulator 42 can then be subjected to a final finishing step or correction in a filter circuit 44, which, as mentioned above, makes it possible to imitate the radiation behavior of the instrument to be imitated or makes it possible to bring about other changes.

The amplitude driving signal or control signal from the pulse breadth control circuit 34 can be supplied to the pulse generator 30 and/or a network 43, following the amplitude modulator 42 for changing the pulse breadth and/or pulse shape.

Since the modification of the volume characteristic or the sounds produced by means of a natural instrument is not primarily based on a frequency-linear emphasis of the amplitude and instead is due to a change in the timbre (SCHUMANN'S Shift Law) in the case of the device in accordance with FIG. 4 with an increase in "volume" a certain range in the frequency spectrum is emphasized in relation to the other spectral components in amplitude. This can be brought about by means of a filter circuit 46 for broad band treble emphasis, whose frequency response can be adjusted by means of the register 28 and whose influence can be controlled by a control signal applied via a line 48, this signal being obtained by a circuit arrangement 50 with a logarithmic transmission function from the output signal of the rectifying and low pass filter circuit 36. The circuit arrangement 50 can naturally also have a transmission function different to a logarithmic function.

The control signal on the line 48 can be supplied not only to the filter circuit 46 but also to the pulse breadth control circuit 34 or to the latter alone in order to bring about small changes in the pulse breadth and/or pulse shape (for example flank slope) in accordance with the volume and more particularly it can shorten somewhat the pulse breadth with an increase in volume or, respectively, it can make the slopes of the flanks steeper.

The output signal of the filter circuit 46 is amplified in an end amplifier 52 and is then supplied to the loudspeaker 18 and another electro-acoustic reproducing device and/or a recording device.

The register 28 is preferably so preprogrammed that the desired instruments or timbres can be obtained by the simple actuation of switches or the like.

In the case of the device represented in FIG. 5, it is a question of an electronic wind instrument, in the case of which the basic frequency of the tones or notes to be produced is controlled by a keyboard which is not shown and whose keys operate associated switches 54. The switches 54 for their part control a pulse generator 56, which operates in a manner similar to the pulse generator 30 of the device in accordance with FIG. 4 and supplies pulses whose breadth and shape can be adjusted by a register 58. The change in pulse breadth on exceeding a certain pitch is in accordance with rules explained above and can be brought about in this case simply by means of an additional contact set in register 58, which is operated by the keys for higher tones.

All other parameters of the sounds to be produced such as volume, attack and decay and the fine modulation control of the amplitude, phase and timbre behavior are controlled in the case of the device in accordance with FIG. 5, as is the case with a normal wind instrument, by the player blowing into a pipe 62. The air current 64 produced by the player in the pipe 62 produces a noise, which is converted by a microphone 66 into an electric signal. After amplification in a preamplifier 68 the first two frequency maxima belonging to the blowing apparatus are filtered out by band filters 70 and 72, respectively, and the output signals of the filters are rectified in circuits 74 and 76, respectively, and integrated. The direct voltages obtained have an amplitude behavior as is necessary for controlling the timbre-wise dynamics. The output signal corresponding to the first frequency maximum from the circuit arrangement 74 drives an amplitude modulator 78 corresponding to the amplitude modulator 42 in FIG. 4, while the output signal from the circuit arrangement 76 controls a filter circuit 80 for board band treble emphasis, which corresponds to the filter circuit 46 in FIG. 4. The breadth of the pulses is modulated in the pulse generator 56 for obtaining phase modulation of the sound signal to be produced with the noise signal from the output of pre-amplifier 68, which for this purpose is suitably rectified and filtered. The output pulses of the pulse generator 56, after amplitude modulation in the amplitude modulator 78 are supplied via a correction filter 82, corresponding to the filter circuit 44 in FIG. 4, to the filter circuit 80. The output signal of the filter circuit 80 can have impressed on it a noise fraction from the output of the pre-amplifier 68 via a band filter 84, whose characteristic can be adjusted by means of the register 58. Finally the signal obtained is amplified by a final amplifier 86 and is supplied to a sound reproducing device, now shown, or to a recording device.

The output signal of the circuit arrangement 76 can furthermore or also exclusively be supplied to a pulse shaping circuit 79, following the amplitude modulator 78, for changing the pulse breadth and/or the pulse shape.

The transmission functions of the various stages can be controlled by the programmed register 58, as is shown in FIG. 5, by suitable connections.

In the case of the amplitude modulation in the amplitude modulator 78 and in the case of the broad band treble emphasis in the filter circuit 80, it is possible, in accordance with the instrument to be imitated, to provide a compression of the dynamics controlled by the noise and an adaptation of the integration time of the circuits 74 and 76 respectively in accordance with an advantageous feature of the invention.

In the case of the device in accordance with FIG. 5 it is possible to imitate the sounds of classical instruments in a very natural manner without it being necessary to put up with the disadvantages of the skill required for playing natural instruments.

In the case of the device in accordance with FIG. 5 preferably a barrier or locking device is provided which prevents simultaneous coming into action of several keys of the keyboard. On the other hand the device can also be constructed for playing two or more voices. In this case a suitable number of pulse generators and possibly of amplitude modulators, filters, register units etc. is provided and between the switches 54 and 60 and the pulse generators a switching logic system is provided which determines which of the several depressed keys controls which sound generator part.

Multi-voiced playing is also conceivable by dividing up the keyboard and the arrangement of several keyboards on one instrument. The register 28 is generally to be so constructed that it brings about a suitable setting of the dynamic ranges. Thus for example the voltages applied to the amplitude integrator circuits 38 and, respectively, 74, 76 can be so compressed or expanded that they are adapted to the dynamic range (span from pianissimo to fortissimo) of the instrument to be imitated.

If the method in accordance with the invention is not realized by the use of a device of the type described in FIGS. 4 and 5 and instead is realized with a device along the lines of an organ or by means of a device controlled by a programming medium as for example a punched tape, no information is provided as regards the attack and decay events. In the case of imitation of sounds of a classical musical instrument, as for example a wind, stringed or keyboard instrument, however, it is necessary to imitate also the attack and possibly also the decay, if the imitated sound is to sound "natural". This can be carried out in accordance with the invention by means of a filter or more particularly a formant filter or the like circuit arrangement provided with time constants, which has substantially the same attack behavior as the instrument to be imitated. In contrast to conventional filter circuits, in the case of which the shortest possible attack is aimed at, this filter circuit is intentionally so constructed that it provides a prolonged specific attack period, possibly with an overbeat effect and the like. A sound signal which suddenly starts is thus so changed by such a filter circuit that it has any desired attack behavior suited to the instrument which is to be imitated.

Such a "attack filter" is naturally not restricted to devices for carrying out the method described here for electronic sound production and instead can with advantage also be used in the case of devices for sound production in the case of which the sound signals are produced or processed in another manner.

In the case of an organ-like device for carrying out the present method it is possible for example the correction filter 44 or 82 in a suitably modified circuit arrangement to assume the function of the "attack filter".

Figure 6:
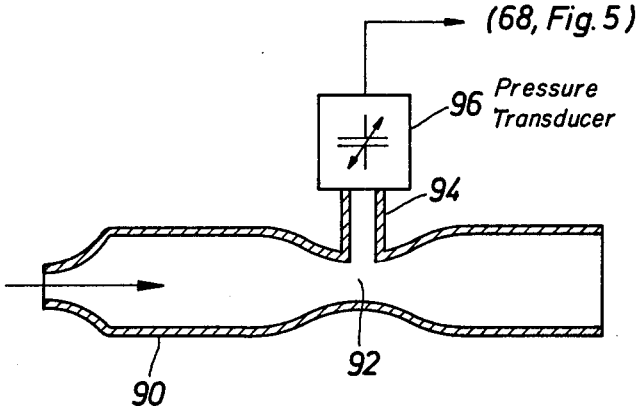
FIG. 6 is a diagrammatic representation of a breath transducer which can be used in lieu of the breath transducer represented in FIG. 5.

The breath transducer represented in FIG. 6 comprises a pipe 90, through which the player blows. The pipe has a cross-sectional restriction 92, which is connected with a branch duct 94 which leads to a mechanical to electrical pressure transducer 96 which can be constructed along the lines of a capacitor microphone and can have a response range of for example 0 to 8 KHz or above. The response range is thus to extend from very low frequencies to relatively high audio-frequencies.

Owing to the restriction 92 there is an increase in velocity in the blowing air current or flow and a resulting reduction in pressure, which is converted by the pressure transducer 96 into a corresponding electrical signal. This electrical signal can be supplied to the amplifier 68 (see FIG. 5) and can then be processed further in the manner indicated in that respect or in any other manner.

What we claim is:

1. A method for the electronic production of sounds from a sequence of periodic electrical pulse signals, the sounds to be produced having an adjustable pitch and a predetermined timbre, which is determined by an amplitude/frequency function determined by the pulses, the frequency function having a formant character and, above a fundamental frequency corresponding to the pitch of the sounds to be produced from the sequence, at least one amplitude minimum, the cycle duration of the sequence being the reciprocal of the pitch, comprising the steps of: maintaining, for cycles having only one pulse and pulse pause, the duration of each of one of the pulse and pulse pause of each of such cycles of the sequence constant for all pitches within a predetermined pitch range, which includes at least one fifth; for cycles having more than one pulse and pulse pause which form respectively a pulse distribution pattern and a pulse pause distribution pattern for each of such cycles, maintaining the duration of each pulse within the pulse distribution pattern or the duration of each pulse pause within the pulse pause distribution pattern of each of such cycles of the sequence constant for all pitches within the predetermined pitch range; and transducing said sequence into sounds, wherein the pulse shape is not rectangular.

2. A method in accordance with claim 1, wherein said sequence has a frequency spectrum having more than one amplitude minimum, wherein the pulse duration is substantially the reciprocal of the frequency of the minimum having the lower or lowest frequency of said more than one amplitude minimum.

3. A method in accordance with claim 1, wherein the pulse shape corresponds to a half cosine oscillation.

4. A method in accordance with claim 2, wherein the pulse shape is asymmetrical.

5. A method in accordance with claim 1, wherein the duration of one of the pulse and pulse pause is reduced on exceeding a predetermined pitch, which thereby delimits the predetermined pitch range.

6. A method in accordance with claim 1, wherein the predetermined pitch range is an octave.

7. A method in accordance with claim 5, wherein the duration of one of the pulse and pulse pause is reduced on exceeding the predetermined pitch range to a fraction of the previous duration of the respective one of the pulse and pulse pause.

8. A method in accordance with claim 7, wherein the reduced duration of one of the pulse and pulse pause is held substantially constant in a second pitch range of at least an octave.

9. A method in accordance with claim 1, wherein the pulse shape is triangular.

10. A method in accordance with claim 7, wherein the fraction is one-half.

11. A device for producing sounds from a sequence of periodic electrical pulse signals, which are responsive to a pitch control signal, the sounds to be produced having an adjustable pitch and a predetermined timbre, which is determined by an amplitude/frequency function determined by the pulses, the frequency function having a formant character and, above a fundamental frequency corresponding to the pitch of the sounds to be produced from the sequence, at least one amplitude minimum, the cycle duration of the sequence being the reciprocal of the pitch, comprising: a pulse generator for producing the pulses of the sequence in a predetermined shape; means generating a pitch control signal; means responsive to the pitch control signal for controlling the pulse generator in such a manner that the pulses therefrom are produced with a cycle duration controlled by the pitch control signal; pulse breadth control means for determining the duration of one of the pulse and pulse pause of the pulses produced by the pulse generator in such a manner that the duration of one of the pulse and pulse pause is substantially independent of the cycle duration of the sequence over a predetermined frequency range of pulse cycles and for changing the duration of one of the pulse and pulse pause upon exceeding a predetermined limit of the frequency range of the pulse cycles; means for producing sounds from said sequence; an amplitude modulator means for modulating said sequence with an amplitude control signal; circuit means for producing the amplitude control signal by extraction of amplitude information from a generated preselected sound; and further comprising a threshold means for permitting the production of the amplitude control signal only when the amplitude information, obtained from the preselected sound, exceeds a predetermined threshold value.

12. A device in accordance with claim 11, further comprising circuit means for producing the pitch control signal by extraction of the fundamental frequency from a preselected sound.

13. A device in accordance with claim 12, wherein the circuit means includes a trigger circuit and a frequency converting circuit, connected between the trigger circuit and the pulse generator for multiplying the frequency of an output signal from the trigger circuit by a factor of either n or 1/n, where n is a whole number, not equal to zero.

14. A device in accordance with claim 11, wherein an output signal of the amplitude modulator means is supplied to a relatively broad band high pass filter, having a frequency response which is controlled by the amplitude control signal.

15. A device in accordance with claim 11, wherein the amplitude control signal controls at least one of the pulse breadth control means and the pulse generator.

16. A device in accordance with claim 11, wherein the amplitude control signal controls a network, connected with the output of the amplitude modulator means, for changing at least one of the pulse breadth and pulse shape.

17. A device for producing sounds from a sequence of periodic electrical pulse signals, which are responsive to a pitch control signal, the sounds to be produced having an adjustable pitch and a predetermined timbre, which is determined by an amplitude/frequency function determined by the pulses, the frequency function having a formant character and, above a fundamental frequency corresponding to the pitch of the sounds to be produced from the sequence, at least one amplitude minimum, the cycle duration of the sequence being the reciprocal of the pitch, comprising: a pulse generator for producing the pulses of the sequence in a predetermined shape; means generating a pitch control signal; means responsive to the pitch control signal for controlling the pulse generator in such a manner that the pulses therefrom are produced with a cycle duration controlled by the pitch control signal; pulse breadth control means for determining the duration of one of the pulse and pulse pause of the pulses produced by the pulse generator in such a manner that the duration of one of the pulse and pulse pause is substantially independent of the cycle duration of the sequence over a predetermined frequency range of pulse cycles and for changing the duration of one of the pulse and pulse pause upon exceeding a predetermined limit of the frequency range of pulse cycles; means for producing sounds from said sequence, and further comprising circuit means, adapted to be controlled by a keyboard, for producing the pitch control signal.

18. A device in accordance with claim 17, further comprising a format filter for said sequence.

19. A device in accordance with claim 17, further comprising a register for setting circuit parameters which influence the tone characteristic of the sounds to be produced.

20. A device in accordance with claim 17, further comprising amplitude modulator means for modulating said sequence with an amplitude control signal, and circuit means for producing the amplitude control signal from the amplitude information of a noise signal.

21. A device in accordance with claim 20, wherein the amplitude control signal is supplied to the amplitude modulator means by way of a threshold means for permitting tone production only above a predetermined response threshold.

22. A device in accordance with claim 20, wherein the circuit means includes a first amplitude integrator circuit means for responding to a predetermined frequency range of the noise signal, which is so high in pitch that low frequency interfering noises cannot affect said amplitude control signal.

23. A device in accordance with claim 22, wherein an output signal from the first amplitude integrator circuit means controls another circuit means for shortening the pulse breadth with an increase in amplitude.

24. A device in accordance with claim 22, wherein an output signal from the first amplitude integrator circuit means is supplied to a frequency vibrator circuit for making slight periodic variations in the length of the pulse cycle duration.

25. A device in accordance with claim 22, further comprising second amplitude integrator circuit means for responding to a frequency range of the noise signal which is higher in pitch than the predetermined frequency range of the first amplitude integrator circuit means, and a broad band high pass filter, coupled with an output of the amplitude modulator means, whose frequency response is controlled by an output signal from the second amplitude integrator circuit means.

26. A device in accordance with claim 25, wherein the output signal of the second amplitude integrator circuit means is supplied to at least one of the pulse breadth control means and the pulse generator.

27. A device in accordance with claim 25, wherein the output signal of the second amplitude integrator circuit means is supplied to a pulse shaping circuit means, which is connected with the output of the amplitude modulator means, for changing at least one of the shape of the pulses and the breadth of the pulses.

28. A device in accordance with claim 17, further comprising keyboard means, wherein the pulse breadth control means is controlled by the keyboard means.

* * * * *